United States Patent [19]

Johnson et al.

[11] Patent Number: 4,476,833

[45] Date of Patent: Oct. 16, 1984

[54] PHASE ANGLE MODIFICATION OF THE TORQUE AMPLITUDE FOR FUEL DISTRIBUTION CONTROL SYSTEMS

[75] Inventors: Edwin A. Johnson, Clarkston; Chun K. Leung, Bloomfield Hills, both of Mich.

[73] Assignee: The Bendix Corporation, Southfield, Mich.

[21] Appl. No.: 435,835

[22] Filed: Oct. 21, 1982

[51] Int. Cl.[3] ..... F02B 3/00; F02P 5/04

[52] U.S. Cl. ..... 123/436; 123/419; 73/517 A

[58] Field of Search ..... 123/419, 436; 74/80, 74/860; 364/431.08; 73/517 A, 579

[56] References Cited

U.S. PATENT DOCUMENTS 4,197,767 4/1980 Leung ..... 123/436

4,357,662 11/1982 Schira et al. ..... 364/431.08

4,418,669 12/1983 Johnson et al. ..... 123/419

*Primary Examiner*—Ronald B. Cox

*Attorney, Agent, or Firm*—James R. Ignatowski; Russel C. Wells

[57] ABSTRACT

A fuel distribution control system for an internal combustion engine including means for detecting the instantaneous rotational velocity of the engine's crankshaft to generate a torque impulse amplitude signal and a phase angle signal, an amplitude correction circuit for correcting the torque impulse amplitude signal as a function of the phase angle signal, means for generating an amplitude error signal for each corrected torque impulse, and means for accumulating said amplitude error signals to generate individual fuel correction signals for each engine cylinder. The fuel correction signals are added to the fuel quantity signals generated by a fuel control computer in response to the operational parameters of the engine and a fuel delivery device responds to the combined fuel quantity and fuel correction signals to deliver a quantity of fuel to each engine cylinder tending to equalize the torque contribution of each cylinder to the total output torque of the engine.

22 Claims, 6 Drawing Figures

PHASE ANGLE MODIFICATION OF THE TORQUE AMPLITUDE FOR FUEL DISTRIBUTION CONTROL SYSTEMS

CROSS REFERENCE

The invention is related to commonly assigned copending U.S. Pat. No. 4,357,662 "Closed Loop Timing and Fuel Distribution Controls" filed Sept. 15, 1980 which is a continuation of patent application Ser. No. 904,131 filed May 8, 1978 now abandoned and co-pending patent application Ser. No. 399,537 Fuel Distribution Control System for an Internal Combustion Engine" filed July 19, 1982, now U.S. Pat. No. 4,418,669.

FIELD OF THE INVENTION

The invention is related to the field of internal combustion engine controls and in particular to a circuit for computing the quantity of fuel to be delivered to each cylinder of the engine to equalize the torque contribution of each cylinder to the total torque output of the engine.

PRIOR ART

Electronic ignition and fuel control systems for internal combustion engines are finding acceptance in automotive and allied industries as a result of substantial increases in fuel costs and pollution standards imposed by government.

R. W. Randall and J. D. Powell of Stanford University in their research under a Department of Transportation sponsored project determined that for maximum efficiency of an internal combustion engine, the spark timing should be adjusted to provide a maximum cylinder pressure at a predetermined crankshaft angle past the piston's top dead center position. The results of this investigation are published in Final Report No. SU-DAAR-503 entitled "Closed Loop Control Internal Combustion Engine Efficiency and Exhaust Emission." This report contains a block diagram of a closed loop system incorporating a circuit which detects the angle at which peak pressure occurs then compares this angle with the predetermined angle to generate an error signal. This error signal is then used to correct the ignition timing signal generated in response to other sensed engine parameters as is known in the art.

C. K. Leung and R. W. Seitz in commonly assigned copending U.S. Pat. No. 4,357,662 filed Sept. 15, 1980 disclose an alternate closed loop engine timing control which computes the phase angle of the torque impulse applied to the engine's output shaft by the individual pistons. The method for calculating the phase angle of the torque impulse disclosed in U.S. Pat. No. 4,357,662 is based on the theory that the phase angle of the torque impulse is indicative of the angle at which maximum pressure occurs in the cylinder. This patent application further discloses a fuel distribution system directed to equalizing the torque contribution of each cylinder to the total torque output of the engine. In the disclosed system, the magnitude of the torque produced by each cylinder is computed and compared with an average torque value to generate a correction signal. The correction signal is then used to correct the quantity of fuel being delivered to the engine. This fuel distribution is based on the assumption that the timing, ignition or fuel injection, is being independently corrected by the timing circuit. As stated in U.S. Pat. No. 4,357,662 the interaction between independent closed loop controls could be counterproductive or result in overcorrection. Therefore the individual corrections should be made in accordance with the discussed "state variable theory".

In commonly assigned U.S. Pat. No. 4,418,669 filed July 19, 1982 there is disclosed an improved fuel distribution control system for correcting the fuel delivery to the individual cylinder of the engine in which the computed amplitude of the torque impulse is corrected when the angle of the torque impulse is different from a desired phase angle. The control system disclosed in U.S. Pat. No. 4,418,669 is correct if the error in the phase angle is caused by an ignition signal, in the case of a spark ignited engine, or injection signal, in the case of a compression ignited (Diesel) engine, retarded from the desired or optimum crankshaft angle. However, the correction is improper if the ignition or injection signal is advanced from the desired or optimum crankshaft angle. The invention is an improved circuit which detects whether the phase angle error is the result of the ignition or injection signal being advanced or retarded from the desired crankshaft angle and corrects the amplitude of the torque impulse signal accordingly.

SUMMARY OF THE INVENTION

The invention is a circuit for correcting the measured amplitudes of the torque input pulses in an internal combustion engine fuel distribution control system. The fuel distribution control system comprises a fuel control computer for generating signals indicative of the engine's fuel requirements in response to operator inputs and the operating parameters of the engine, a fuel delivery system for delivering fuel to the engine in response to the signal generated by the fuel control computer, a digital period analyzer for computing the amplitude and phase angle of each torque impulse imparted to the engine's crankshaft from the burning of the delivered fuel, means for correcting the computed amplitude of the torque impulse as a function of the computed phase angle, means responsive to the corrected amplitude for generating a fuel correction signal for each cylinder of the engine, and means for summing the correction signal with the signal generated by the fuel control computer. The corrected signal tending to equalize the torque impulses generated by all of the cylinders. In particular, the means for correcting the computed amplitude signal includes means for substracting the computed phase angle from predetermined limits to generate a pair of error signals, switch means responsive to said pair of error signals for outputing the error signal indicative of the magnitude and the direction of the phase angle error, means for multiplying the output error signals by a constant to generate an amplitude correction signal, and means for summing the amplitude correction signal with the computed amplitude signal to generate a corrected amplitude signal.

The advantage of the circuit is that the computed amplitude of the torque impulse is properly corrected for retarded as well as advanced phase angle errors. This and other advantages of the phase angle correction circuit will become more apparent from a reading of the Specification in conjunction with the drawings.

DETAILED DESCRIPTION OF THE INVENTION

Figure 1:
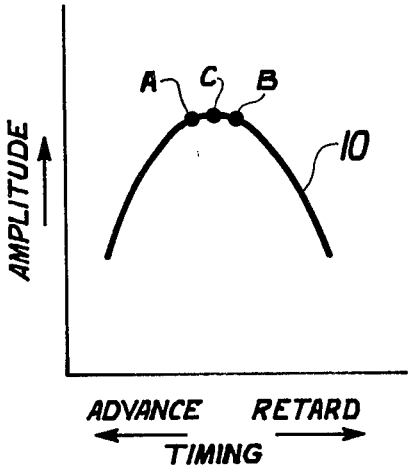
FIG. 1 is a graph showing the amplitude of the torque impulses as a function of timing.

FIG. 1 is a graph showing the amplitude of an individual torque impulse imparted to the crankshaft of an internal combustion engine as a function of timing. The timing may be ignition timing in the case of a spark ignited engine or fuel injection timing in the case of a compression ignited or Diesel engine. As is known in the art, the torque goes through a peak or maximum value designated as point C on the torque amplitude curve 10. Optimum timing however is achieved over a small timing range near the peak of the torque curve designated between points A and B. U.S. Pat. No. 4,357,662 "Closed Loop Timing and Fuel Distribution Controls," filed Sept. 15, 1980 discloses that the phase angle of the torque impulses imparted to the engine's crankshaft by the individual cylinder is indicative of the timing. Therefore, timing points A and B may be represented by phase angles $\phi_1$ and $\phi_2$ respectively as shown on FIG. 2. Point C represents the desired timing and is represented by the phase angle $\phi_0$.

Figure 2:
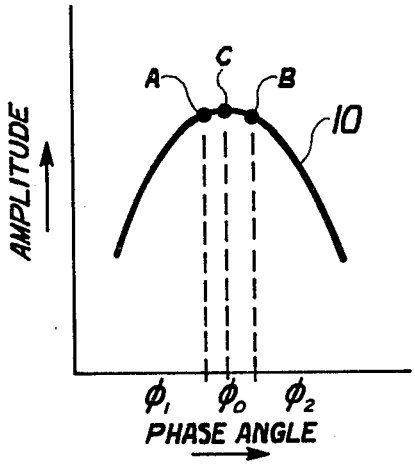
FIG. 2 is a graph showing the amplitude of the torque impulses as a function of their phase angle.

As noted from FIG. 2 if the phase angle $\phi$ of the individual torque impulse is less than $\phi_1$, the amplitude of the torque impulse is smaller than it would have been if the timing was correct. Likewise if the phase angle $\phi$ is greater than $\phi_2$ the amplitude also is smaller than it would have been if the timing was correct. The amplitude of the torque impulse may therefore be corrected as a function of the phase angle error. The timing or phase angle errors may be common to all of the cylinders or vary from cylinder to cylinder due to other factors as is known in the art.

The correction $\Delta A_\phi$ of the amplitude of the torque impulses for phase angles less than $\phi_1$ may be computed from the equation:

$$\Delta A_\phi = K_1 f(\phi_1 - \phi) \quad (1)$$

In a like manner the correction A of the amplitude of the torque impulses for phase angles greater than $\phi_2$ may be computed from the equation:

$$\Delta A_\phi = K_2 f(\phi - \phi_2)$$

or $$\Delta A_\phi = -K_2 f(\phi_2 - \phi) \quad (2)$$

The factors $K_1$ and $K_2$ are constants and may be the same or different depending upon the dynamics of the engine. The phase angle $\phi_1$ and $\phi_2$ are the phase angles corresponding to timing points A and B respectively on FIG. 2. The phase angle $\phi$ is the phase angle of the instant torque impulse. No correction to the torque impulse amplitude is required in the timing range between $\phi_1$ and $\phi_2$ since this is the optimum timing range and the amplitude of the torque impulse is considered to be maximized for the particular operating state of the engine.

Figure 3:
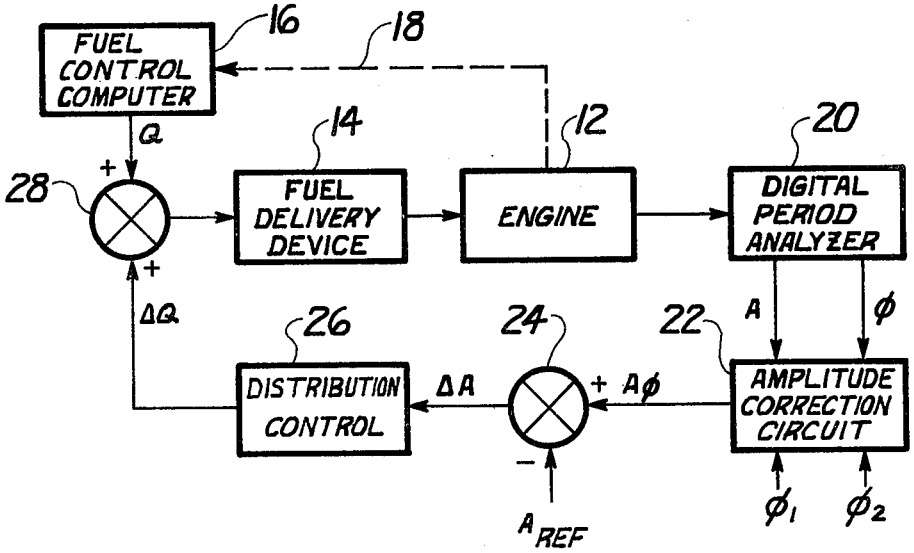
FIG. 3 is a block diagram of a fuel distribution system incorporating an amplitude correction circuit.

The block diagram of a fuel distribution control system incorporating an amplitude correction circuit able to correct the amplitude of the period wave generated in response to phase angle errors less than $\phi_1$ or greater than $\phi_2$ is shown in FIG. 3. Referring to FIG. 3 an internal combustion Engine 12 receives fuel from a Fuel Delivery Device 14 in response to a fuel quantity signal Q generated by a Fuel Control Computer 16. The Engine 12 may be of any type known in the art, compression ignited (Diesel) or spark ignited. The Fuel Delivery Device 14 may be multiple fuel injectors, one for each of the engines cylinders, a single fuel injector delivering fuel into the intake manifold for all the engine cylinders, a mechanical or electrically actuated carburetor or any other type of fuel delivery device known in the art. The Fuel Control Computer 16 may be of any known type which generates an electrical, mechanical or fluidic signal Q indicative of the engines fuel requirements in response to operator inputs and the operational parameters of the engine. It is assumed the Engine 12 is equipped with sensors detecting the desired operating parameters, such as engine temperature, engine speed, air intake manifold pressure, mass air flow rate and others as is known in the art. Dashed feedback line 18 collectively indicates the communication of these parameters from the Engine 12 to the Fuel Control Computer 16. A Digital Period analyzer 20, such as disclosed in U.S. Pat. No. 4,357,662, generates a phase angle signal $\phi$ and an amplitude signal A for each torque impulse in response to the instantaneous rotational velocity of the Engine's crankshaft or other suitable output member. Preferably the phase angle signal $\phi$ is corrected for changing engine speed as disclosed in patent application, Ser. No. 399,528 entitled "Phase Angle Detector" filed July 19, 1982. Copending patent applications, Ser. Nos. 187,400, 399,537 and 399,538 are incorporated herein by reference.

The Digital Period Analyzer 20 computes the amplitude signal A from the Fourier functions A sin $\phi$ and A cos $\phi$ generated in the computation of the phase angle $\phi$ in accordance with the equation:

$$A = \sqrt{(A \sin \phi)^2 + (A \cos \phi)^2} \quad (3)$$

where A is the amplitude of the torque impulse and $\phi$ is the phase angle of the torque impulse. Emperically it has been determined that the amplitude signal A should also be corrected for the difference in engine speed x at the beginning and end of each torque impulse. Therefore the Digital Period analyzer 20 may output a corrected amplitude signal A' having a value:

$$A' = A - kx \quad (4)$$

where A is the amplitude signal computed in accordance with equation (3), k is a constant, and x is the difference in engine speed at the beginning and end of the torque impulse.

The phase angle $\phi$ is computed in accordance with the equation $$\phi = \arctan (A \sin \phi / A \cos \phi) \quad (5)$$

The amplitude signal A (or A') and the phase angle signal $\phi$ computed by the Digital Period analyzer 20 are received by an Amplitude Correction Circuit 22 along with reference phase angle signals $\phi_1$ and $\phi_2$. The Amplitude Correction Circuit 22 computes an amplitude correction signal $\Delta A$ in accordance with the equations (1) and (2) which is summed with the amplitude signal A (or A') and outputs a phase angle corrected amplitude signal $A_\phi$. A reference amplitude signal $A_{REF}$ is then subtracted from the phase angle corrected amplitude signal $A_\phi$ in substraction circuit 24 to generate an amplitude error signal $\Delta A$. The reference amplitude signal $A_{REF}$ may be generated by averaging the amplitude signals A output from the Digital Period Analyzer 20 or may be generated as a function of engine speed as disclosed in patent application, Ser. No. 399,537 incorporated herein by reference.

The amplitude error signal $\Delta A$ is received by a Distribution Control Circuit 26 which integrates the amplitude error signals $\Delta A$ generated with respect to each engine cylinder to generate a correction signal $\Delta Q$ which when added to the fuel delivery signal Q generated by the Fuel Control Computer 16 tends to equalize to amplitudes of the torque impulses generated by all of the engine's cylinders. The details of the Fuel Distribution Control 26 are fully described in patent application, Ser. No. 399,537 cited above. Briefly, the Distribution Control 26 comprises a plurality of accumulators one for each engine cylinder which stores the sum of the amplitude error signals generated with respect to the associated engine cylinder. A decoder responsive to the rotational position of the engine's crankshaft enables the accumulators one at a time and in a predetermined sequence to receive the error signals and to output the fuel correction (accumulated error) signals $\Delta Q$ in a timed sequence with respect to the operating cycle of the engine. The Distribution Control 26 therefore outputs the correction signal $\Delta Q$ for each cylinder in synchronization with the fuel signal generated by the Fuel Control Computer 16. The fuel signal Q and fuel correction signal $\Delta Q$ are summed in sum amplifier 28 to generate a corrected fuel signal $Q+\Delta Q$ which activates the Fuel Delivery Device 14 to deliver a quantity of fuel to that particular cylinder tending to equalize the torque impulse of that cylinder wth the torque impulses generated by the other cylinders.

Figure 4:
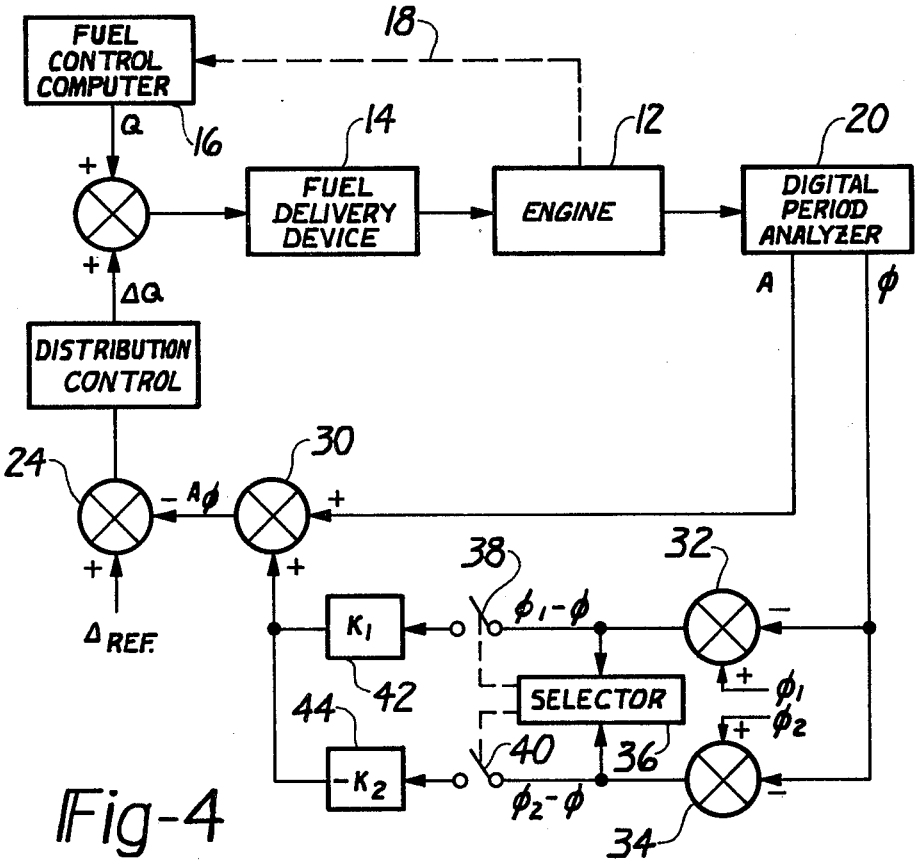
FIG. 4 is a block diagram of the fuel distribution system of FIG. 3 showing the amplitude correction circuit in greater detail.

FIG. 4 is a block diagram of the fuel distribution system of FIG. 3 showing the functional details of the Amplitude Correction Circuit 22. The Fuel Delivery Device 14, Fuel Control Computer 16, Digital Period Analyzer 20, Distribution Control 26, difference amplifer 24 and sum amplifier 28 are functionally the same as described relative to FIG. 3.

Referring now to FIG. 4, the amplitude signal A (or A') output from the Digital Period Analyzer 20 is received at one input of a sum amplifier 30. The phase angle signal $\phi$ is recieved at the negative inputs of difference amplifiers 32 and 34. The positive input of difference amplifier 32 receives the first reference phase angle signal $\phi_1$ and outputs the signal $(\phi_1-\phi)$ and the positive input to difference amplifier 34 receives the reference second phase angle signal $\phi_2$ and outputs the signal $(\phi_2-\phi)$.

A selector 36 responsive to the signals $(\phi_1-\phi)$ and $(\phi_2-\phi)$ controls the operaton of switches 38 and 40. Switch 38 connects the output of difference amplifier 32 to the input of multiplier 42 which multiplies the signal $(\phi_1-\phi)$ with a constant $K_1$ to produce the amplitude correction signal:

$$A_\phi=K_1(\phi_1-\phi)$$

In a like manner switch 40 connects the output of difference amplifier 34 to the input of multiplier 44 which multiplies the signal $(\phi_2-\phi)$ with the constant $-K_2$ to produce the amplitude correction signal:

$$A_\phi=-K_2(\phi_2-\phi)$$

The operational functions of Selector 36 are as follows:

Switch 38 is closed when $(\phi_1-\phi)$ and $(\phi_2-\phi)$ are both positive signals indicating $\phi_1>\phi$.

Switch 40 is closed when $(\phi_1-\phi)$ and $(\phi_2-\phi)$ are both negative indicating $\phi>\phi_2$.

Both switch 38 and 40 remain open when $(\phi_1-\phi)$ is negative and $\phi_2-\phi$ is positive indicating that the phase angle $\phi$ has a value $\phi_1<\phi<\phi_2$.

The outputs of multipliers 42 and 44 are summed with the amplitude signal A (or A') in sum amplifier 30 to generate the phase angle corrected amplitude signal $A_\phi$.

Figure 5:
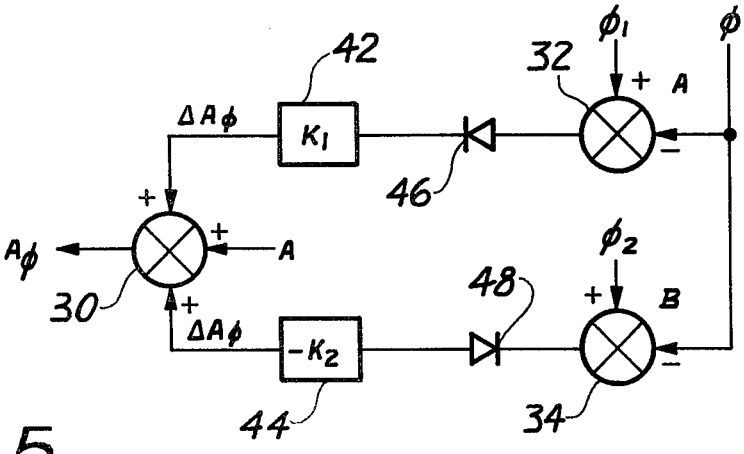
FIG. 5 is a circuit diagram of the amplitude correction.

A circuit implementation of the Amplitude Correction Circuit 22 is shown in FIG. 5. As previously discussed the phase angle signal $\phi$ from the Digital Period Analyzer 20 is received at the negative inputs to difference amplifiers 32 and 34 as discussed relative to FIG. 4. Likewise difference amplifiers 32 and 34 receive the reference phase angle signals $\phi_1$ and $\phi_2$ respectively at their positive inputs. The output of difference amplifier 32 is connected to Multiplier 42 through a diode 46 connected to only pass positive signals. In a similar manner, the output of difference amplifier 34 is connected to Multiplier 44 through diode 48. The outputs of Multipliers 42 and 44 are received by sum amplifier 30 which sums the amplitude correction signal $\Delta A_\phi$ with the computed amplitude signal A to generate the phase angle corrected amplitude signal $A_\phi$. It is recognized that when the Amplitude Correction Circuit is embodied in digital form the digital equivalents of diodes 46 and 48 would be used.

The operation of the Amplitude Correction Circuit 22 is as follows:

When $\phi<\phi_1$ and $\phi_2$ the outputs of amplifiers 32 and 34 are both positive. The positive output of amplifier 32 is passed by diode 46 to Multiplier 42 where it is multiplied by the constant $K_1$ to produce the amplitude correction $\Delta A_\phi=K_1(\phi_1-\phi)$. The positive output of amplifier 34 is blocked by diode 48 and the output of Multiplier 44 is zero.

When $\phi_1<\phi<\phi_2$ the output of amplifier 32 is negative and the output of amplifier 34 is positive. Diodes 46 and 48 effectively block the output signals from both amplifiers and the amplitude correction signal $\Delta A_\phi=0$.

When $\phi>\phi_2$ and $\phi_1$ the output of amplifiers 32 and 34 are both negative. Diode 46 blocks the signal from amplifier 32 while diode 48 passes the negative output of amplifier 34 to Multiplier 44 where it is multiplied by the constant $-K_2$ to produce the amplitude correction signal $\Delta A_\phi=-K(\phi_2-\phi)$.

Figure 6:
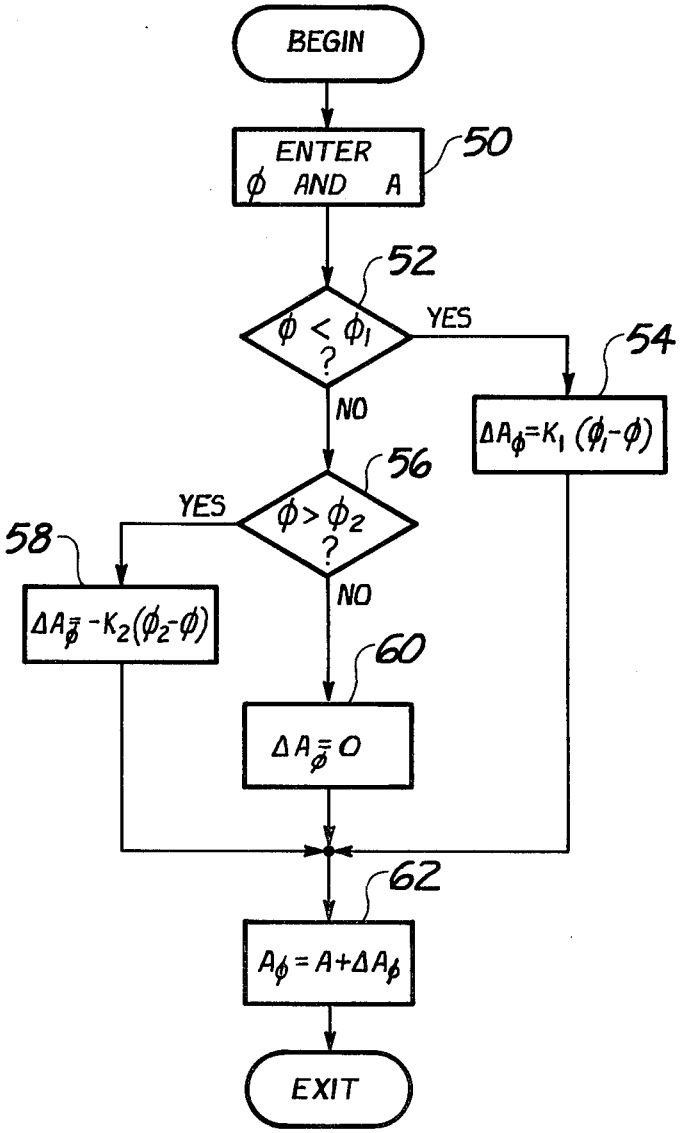
FIG. 6 is a subroutine for a programmed microprocessor for correcting the computed amplitude as a function of the phase angle error.

The Amplitude Correction Circuit 22 may be implemented in analog or digital forms or as a subroutine of a programmed microprocessor as shown in FIG. 6. Referring to FIG. 6, the subroutine begins by entering the phase angle $\phi$ and amplitude A as indicated by block 50. The subroutine inquires if $\phi<\phi_1$ as indicated by decision block 52. If $\phi<\phi_1$ then $\Delta A_\phi=K_1(\phi_1-\phi)$ as indicated by block 54. If $\phi>\phi_1$ then the subroutine inquires if $\phi>\phi_2$ as indicated by decision 56. If $\phi>\phi_2$ then $\Delta A_\phi=-K(\phi_2-\phi)$ as indicated by block 58. If $\phi < \phi_2$ then $\Delta A_\phi = 0$ is indicated by block 60. Finally $A_\phi$ is computed by summing A with $\Delta A_\phi$ to generate the corrected amplitude $\Delta A_\phi$ is indicated by block 62. The subroutine is then exited as indicated.

It is not intended that the fuel distribution system be limited to the specific embodiment illustrated in FIGURES and described herein. Those skilled in the art will be able to make changes within the spirit of the invention as described herein and set forth in the appended claims.

What is claimed is:

1. An improved fuel distribution system for an internal combustion engine having a fuel control computer generating fuel signals in response to the operational parameter of the engine, a fuel delivery system delivering fuel to the engine in response to the fuel signals, a digital period analyzer generating a torque amplitude signal and a phase angle signal in response to the instantaneous rotational velocity of the engine's output member, means detecting the fluctuations of the amplitude signal for generating an amplitude error signal, distribution control responsive to said amplitude error signal for generating a fuel correction signal, and means for summing the fuel correction signal with the fuel signal for generating corrected fuel signal tending to equalize the torque output from all of the engine's cylinders, the improvement characterized by:

amplitude signal correction means for correcting the amplitude signal for timing errors in response to the phase angle signal being smaller than a first predetermined value and larger than a second predetermined value.

2. The fuel distribution system of claim 1 wherein said amplitude correction circuit means comprises:

first difference amplifier means responsive to said phase angle signal for generating a first phase difference signal having a value equal to the difference between said first predetermined value and said phase signal;

second difference amplifier means responsive to said phase angle signal for generating a second phase difference signal having a value equal to the difference between said second predetermined value and said phase signal;

first multiplier means for multiplying said first difference signal by a first constant to generate a first correction signal;

second multiplier means for multiplying said second difference signal by a second constant to generate a second correction signal;

selector means including first means for transmitting said first difference signal to said first multiplier means in response to at least said first difference signal having a positive value, second means for transmitting said second difference signal to said second multiplier means in response to at least said second difference signal having a negative value; and sum amplifier means for summing the said first and second correction signals with said amplitude signal to generate said phase angle corrected amplitude.

3. The fuel distribution system of claim 1 wherein said amplitude correction circuit means comprises:

a first difference amplifier responsive to said phase signal for generating a first difference signal having a value corresponding to the difference between said first predetermined value and said phase signal;

a second difference amplifier responsive to said phase angle signal for generating a second difference signal having a value corresponding to the difference between said second predetermined value and said phase angle signal;

first multiplier means for multiplying said first difference signal by a constant to generate a first correction signal;

second multiplier means for multiplying said second difference signal by a constant to generate a second correction signal;

first transmission means interposed between said first difference amplifier and said first multiplier means for transmitting only said first difference signals having a positive value;

second transmission means interposed between said second difference amplifier and said second multiplier means for transmitting only said second difference signals having a negative value; and means for summing said first and second correction signals with said amplitude signal to generate said phase angle corrected signal.

4. The fuel distribution system of claim 3 wherein said first and second transmission means are a first and second diode.

5. A fuel distribution system for an internal combustion engine having a plurality of cylinders comprising:

fuel control computer means for generating a fuel signal indicative of the engines fuel requirements in response to the operational parameters of the engine;

fuel delivery means for delivering fuel to the engine in response to said fuel signals;

means for detecting the rotational velocity of the engines output member to generate an amplitude signal indicative of the magnitude of each torque impulse imparted to the engines output member and a phase angle signal indicative of the engine's timing parameters;

means for correcting said amplitude signal for timing errors in response to said phase angle signal having a value smaller than a first predetermined value or a value larger than a second predetermined value to generate a phase angle corrected amplitude signal;

means for subtracting a reference amplitude signal from said phase angle corrected amplitude signal to generate an amplitude error signal;

distribution control means responsive to the rotational position of the engine for individually accumulating said amplitude error signals for each cylinder to generate a fuel correction signal; and means for summing said fuel correction signals with said fuel signals to generate a corrected fuel signal for each cylinder; said corrected fuel signals activating said fuel delivery means to deliver a quantity of fuel to each cylinder tending to equalize the contribution of each cylinder to the total torque output of the engine.

6. The fuel distribution system of claim 5 wherein said means for detecting the instantaneous velocity of the engines output member comprises:

means for computing from the instantaneous rotational velocity of the engine's output member the functions A cos $\phi$ and A sin $\phi$ where A is the amplitude of the individual torque impulses imparted to the output member by the burning of the delivered fuel in the engine's cyliders;

means for computing the amplitude of the individual torque impulses according the equation $$A = \sqrt{(A \sin \phi)^2 + (A \cos \phi)^2} \;;$$

and means for computing the phase angle $\phi$ of the individual torque impulses according to the equation:

$$\phi = \arctan [A \sin \phi / A \cos \phi].$$

7. The fuel distribution system of claims 5 or 6 wherein said means for correcting said amplitude signal comprises:

means for subtracting said phase angle signal fom a first predetermined phase angle advanced from the desired phase angle, to generate a first difference signal;

means for subtracting said phase angle signal from a second predetermined phase angle retarded from the desired phase angle to generate a second difference signal first multiplier means for multiplying said first difference signal by a first constant to generate a first correction signal;

second multiplier means for multiplying said second difference signal by a second constant to generate a second correction signal;

selector means including means for transmitting said first difference means to said first multiplier means in response to at least said first difference signal having a positive value and means for transmitting said second difference signal to said second multiplier means in response to at least said second difference signal having a negative value.

8. The fuel distribution system of claim 7 wherein said first included means of said selector means is responsive to both said first and second difference signals having a postive value and said second included means is responsive to both said first and second difference signals having a negative value.

9. The fuel distribution system of claim 7 wherein said first and second included means of said selector means are diodes.

10. The fuel distribution system of claim 7 wherein said first constant has a positive value and said second constant has a negative value.

11. A method for equalizing the torque output of each cylinder of an internal combustion engine comprising the steps of:

detecting the operating parameters of the engine to generate a fuel quantity signal;

delivering fuel to the engine in response to said fuel quantity signal;

detecting the instantaneous rotational velocity of an engine output member to compute the amplitude and phase angle of each torque impulse generated by the combustion of the delivered fuel in the engine's cylinders;

computing the difference between said phase angle and a first phase angle advanced from a desired phase angle to generate a first difference signal;

computing the difference between said phase angle and a second phase angle retarded from said desired phase angle to generate a second difference signal;

generating in response to said fisrt and second difference signals a first correction signal when said phase angle is less than said first phase angle and a second correction signal when said phase angle is greater than said second phase angle;

summing said first and second correction signals with said amplitude to generate a corrected amplitude signal;

generating a reference amplitude signal;

subtracting said reference amplitude signal from said corrected amplitude signal to generate an amplitude error signal; individually accumulating said error signals for each engine cylinder to generate a fuel correction signal for each cylinder; and summing said fuel correction signal one at a time with said fuel quantity signal in a predetermined sequence synchronized with the operation of the engine to generate a corrected fuel quantity signal tending to correct the quantity of fuel delivered to each engine cylinder and equalize the amplitudes of the torque impulses produced by all of the engines cylinders.

12. The method of claim 11 wherein said step of generating said first and second correction signals comprises the steps of:

transmitting said first difference signal to a first multiplier in response to said first difference signal having a value less than said first phase angle;

multiplying in said first multiplier said first difference signal by a first constant to generate said first correction signal;

blocking the transmission of said first difference signal to said first multiplier when said first difference signal has a value greater than said first phase angle signal;

transmitting said second difference signal to a second multiplier in response to said second difference signal having a value greater than said second phase angle;

multiplying in said second multiplier said second difference signal by a second constant to generate said second correction signal; and blocking the transmission of said second difference signal to said second multiplier in response to said second difference signal having a value less than said second phase angle.

13. The method of claims 11 or 12 wherein said step of computing the difference between said phase angle and said first phase angle comprises the step of subtracting said phase angle from said first phase angle to generate said first difference signal; and wherein said step of computing the difference between said phase angle and said second phase angle comprises the step of subtracting said phase angle from said second phase angle to generate said second difference signal.

14. The method of claim 13 wherein said step of generating said first and second correction signals comprises the steps of:

transmitting said first difference signal to a first multiplier in response to said first difference signal having a positive value; and multiplying in said first muliplier said first difference signal by a constant to generate said first correction signal having a value $K_1(\phi_1 - \phi)$ where $K_1$ is said constant, $\phi_1$ is said first phase angle and $\phi$ is said phase angle;

transmitting said second difference signal to a second multiplier in response to said second difference signal having a negative value;

multiplying in said second multiplier said second difference signal by a second constant to generate said second correction signal having a value $K_2(\phi_1-\phi)$ where $K_2$ is a constant, $\phi_2$ is said second phase angle, and $\phi$ is said phase angle.

15. The method of claim 14 wherein $K_2$ has a negative value.

16. The method of claim 15 wherein $K_2$ has a value equal to $-K_1$.

17. A method for correcting the computed amplitude of a torque impulse imparted to a rotary member for phase angle errors comprising the steps of:

detecting the instantaneous rotational velocity of the rotary member to generate an amplitude signal and phase angle signal indicative of the actual amplitude and phase angle of each torque impulse;

computing the difference between said phase angle signal and a first reference phase angle advanced from a desired phase angle, to generate a first difference signal;

computing the differnce between said phase angle signal and a second reference phase angle retarded from said desired phase angle to generate a second difference signal;

generating in response to said first and second difference signals a first correction signal when said phase angle signal is smaller than at least said first reference phase angle and a second correction signal when said phase angle signal is larger than at least said second reference phase angle; and summing said first and second correction signals to said amplitude signal to generate a phase angle corrected amplitude signal.

18. The method of claim 17 wherein said step of generating said first and second correction signals comprises the steps of:

multiplying said first difference signal by a first constant in response to said first difference signal having a value less than said first reference phase angle; and multiplying said second difference signal by a second constant in response to said second difference signal having a value greater than said second reference signal.

19. The method of claim 17 wherein said steps of computing the differences between said phase angle signal and said first and second reference phase angles comprises the steps of:

subtracting said phase angle signal from said first reference phase angle to generate said first difference signal; and subtracting said phase angle signal from said second reference phase angle to generate said second difference signal.

20. The method of claim 19 wherein said step of generating said first and second correction signals comprises the steps of:

multiplying said first difference signal by a constant $K_1$ to generate said first correction signal having a value $K_1(\phi_1-\phi)$ where $\phi_1$ is said first reference phase angle and $\phi$ is said phase angle signal; and multiplying said second difference signal by a constant $K_2$ to generate said second correction signal having a value $K_2(\phi_2-\phi)$ where $\phi_2$ is said second reference phase angel and $\phi$ is said phase angle signal.

21. The method of claim 20 wherein $K_1$ has a positive value and $K_2$ has a negative value.

22. The method of claim 20 wherein $K_2$ has a value equal to $-K_1$.

* * * * *